United States Patent [19]

Minin et al.

[11] 4,081,982

[45] Apr. 4, 1978

[54] PLANT FOR EXPLOSION WORKING OF MATERIALS

[76] Inventors: Vladilen Fedorovich Minin, ulitsa Tereshkovoi, 36a, kv. 14; Vitaly Stepanovich Gambarov, ulitsa Promyshlennaya, 8, kv. 73; Mikhail Samuilovich Kachan, ulitsa Pravdy, 9, kv. 38; Vladlen Alexeevich Okladnikov, ulitsa Oleko Dundicha, 29, kv. 13; Boris Leonidovich Troinin, ulitsa Grekova, 13; Jury Alexeevich Trishin, ulitsa Zolotodolinskaya, 9, kv. 5, all of Novosibirsk, U.S.S.R.

[21] Appl. No.: 731,412

[22] Filed: Oct. 12, 1976

[51] Int. Cl.[2] ..... B21D 26/12

[52] U.S. Cl. ..... 72/56; 29/421 E

[58] Field of Search ..... 72/56; 29/421 E, 421 R

[56] References Cited

U.S. PATENT DOCUMENTS

| | | | |
|---|---|---|---|
| 3,232,086 | 2/1966 | Inoue | 72/56 |
| 3,267,710 | 8/1966 | Inoue | 72/56 |
| 3,413,833 | 12/1968 | Lieberman et al. | 72/56 |
| 3,464,249 | 9/1969 | Klein | 72/56 |
| 3,644,984 | 2/1972 | Inoue | 72/56 |
| 3,706,538 | 12/1972 | Chew | 423/210 X |
| 3,742,746 | 7/1973 | Erlandson | 72/56 |

*Primary Examiner*—Leon Gilden

*Attorney, Agent, or Firm*—Fleit & Jacobson

[57] ABSTRACT

Plant for explosion working of materials comprises a chamber receiving therein a work table adapted to support a material to be worked and an explosive charge. Mounted within the chamber are electrodes for feeding an electric pulse to an explosion initiating means. There is provided a means for advancing the electrodes into electric contact of the electrodes with the charge initiating means, so that each electrode is advanced toward the last-mentioned means by an extent equalling the length of the electrode, separated therefrom during an explosion. The disclosed plant may find application in various industries and offers a high working capacity.

5 Claims, 5 Drawing Figures

PLANT FOR EXPLOSION WORKING OF MATERIALS

The present invention relates to apparatus for working of materials by way of explosion.

A plant constructed in accordance with the present invention can be used in the ferrous and non-ferrous metallurgy, in manufacturing aircraft and rockets, in machine-building, instrument-making and in other industries.

For instance, the present invention can be successfully used for explosion-welding of sealing rings to the pistons of compressors, engines, etc., for explosion-hardening of the teeth of earth-moving machines, for explosion-shaping of articles and blanks from powderized and loose materials, and elsewhere.

Explosion working of materials, e.g. hardening of various machine parts intended for working under heavy loads and under the conditions of heavy-duty operation, is carried out nowadays either on open sites or in underground chambers.

However, explosion working of materials in underground chambers is hampered by the limited working space available and by the unfavourable working conditions underground.

On the other hand, operation on open sites is greatly dependent on the weather conditions and on the time of the year, to say nothing of the need for vast spaces such that open sites for explosion working materials might require.

There are also known above-ground explosion chambers usually utilized for experimental explosions aimed at working various materials. These above-ground chambers are usually shaped as semi-spheres supported by a rigid base with the structure thereof being such that in some case it might include a work table adapted to support thereon the material to be worked. An opening is made through the wall of the chamber, so that the material to be worked upon and an explosive charge can be introduced into the chamber and so that the material can be withdrawn from the chamber after the explosion, the charge having mounted therein a means for initiating an explosion. Mounted in the walls of the chamber are electrodes for feeding an electric supply pulse to the explosion-initiating means.

A considerable drawback of the hitherto known aboveground chambers for explosion working of materials lies in that the explosion-initiating operation therein is not automated. In the hitherto known chambers the electrodes are manually positioned for each working cycle, which would not permit to step up the productivity of labour.

Another disadvantage of the hitherto known chambers is that when toxic materials are worked therein, the chambers are devoid of means capable of neutralizing the toxicity of such materials.

It is an object of the present invention to provide a plant for explosion working of materials, wherein the electrodes should be mounted so as to provide for a stepped-up productivity of the plant.

This and other objects of the invention are attained in a plant for explosion working of materials, comprising a chamber receiving therein a work table adapted to support thereon a material and a charge of an explosive, the chamber having mounted therein electrodes for feeding an electric supply pulse to a charge initiating means, in which plant, in accordance with the present invention, the electrodes, mounted within the chamber, are allowed advancing motion toward the means for initiating the explosion to provide electric contact between the electrodes and this means, there being provided another means for effecting this advancing motion of the electrodes, this last-mentioned means being constructed so that each electrode is advanced toward this explosion initiating means through a distance equal to the length of the portion of the electrode, separated therefrom during an explosion.

With a plant for explosion working of materials having the abovespecified structure, it is possible, during each operation cycle, to ensure automatically controlled feeding of the electrodes toward the explosion initiating means by the distance equalling the length of the portion of the electrode which has been blown off the electrode by the previous explosion.

It is expedient that in the case of working toxic materials the chamber be provided with a nozzle adapted for feeding into the chamber a composition capable of neutralizing the toxicity of the materials.

In this case safe operating conditions are provided for the operator, and the sanitary and hygienic requirements for explosion working of toxic materials are complied with.

A plant for explosion working of materials, constructed in accordance with the present invention, enables to introduce automation into the operation of initiating an explosion and, consequently, makes it possible to make the control of the entire explosion working process fully automatic. When large quantities of materials or articles are worked in a plant according to the present invention, the productivity of labour is significantly stepped up.

The herein disclosed plant for explosion working of materials is structurally simple and offers safe and uncomplicated operation.

The present invention will be further described in connection with an embodiment thereof, with reference being had to the accompanying set of drawings, wherein.

Figure 1:
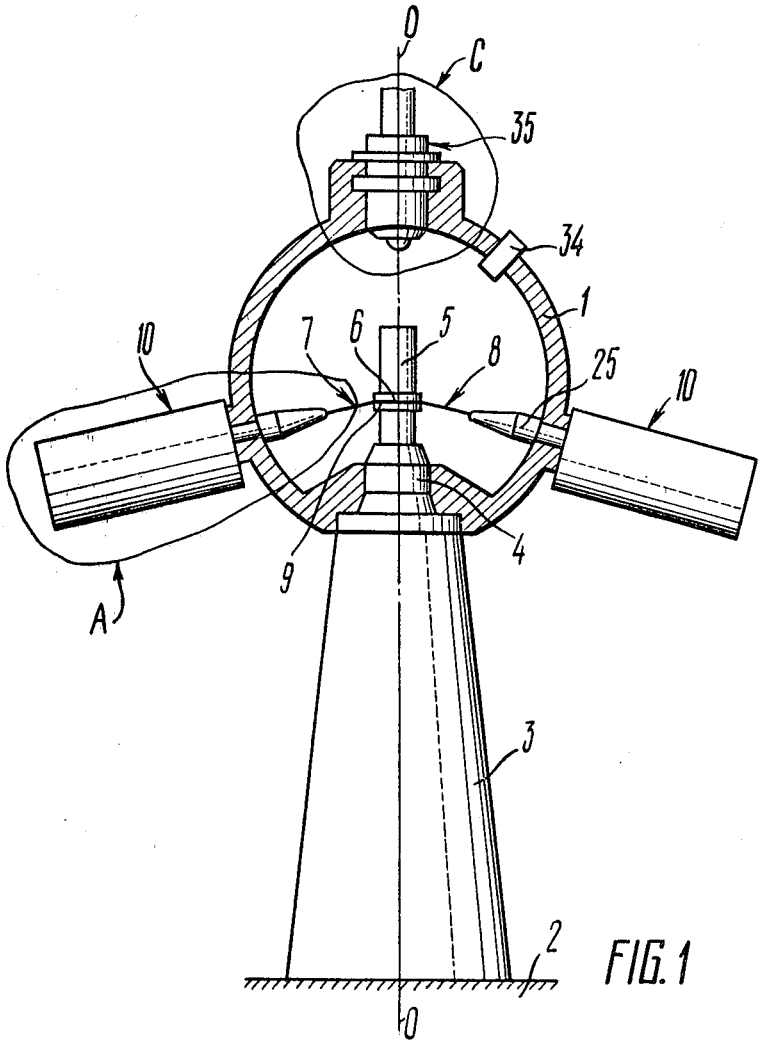
FIG. 1 is a partial longitudinal sectional view of a plant for explosion working of materials in accordance with the present invention.

Referring now in particular to the appended drawings, a plant for explosion working of materials comprises a chamber 1 (FIG. 1) secured to a stationary support 2 by means of supporting stands 3.

For explosion working of materials, there is mounted within the chamber 1 a work table 4 adapted to support thereon a material 5 to be worked and a charge 6 of an explosive, applied onto the material 5 to be worked.

The construction of the work table 4 and its arrangement for reciprocation relative to the chamber 1 are described in detail in our co-pending application, U.S. patent application Ser. No. 725,505, filed Sept. 22, 1976, and so this structure of the table is not described in detail in the present disclosure, so as not to interfere with the essential features of the present invention.

Mounted inside the chamber 1 are electrodes 7 and 8 for feeding a supply electric pulse from a supply source (not shown) to a means 9 for initiating an explosion. In the presently described embodiment this means 9 is in the form of an explosive wire likewise designated with numeral 9 and mounted or embedded within the charge 6 of an explosive, coating the material 5 to be worked.

The electrodes 7 and 8 are mounted for an advancing motion toward the explosive wire 9 and into contact therewith, through a distance equalling the length of the portion of the electrode, separated or blown off therefrom during the preceding explosion.

To this end, the herein disclosed plant for explosion working of materials includes another means adapted for effecting this advancing motion of the electrodes 7, 8, the last-mentioned means in the presently described embodiment being made up by two attachments 10 (FIG. 2) disposed outside the chamber 1 and rigidly attached thereto.

Each attachment 10 includes a hydraulic cylinder 11 communicating with a source of a working fluid under pressure (the source is not shown), the plunger rod of this cylinder having fastened thereto a carriage 13 carrying clamps or grippers 14 attached to the carriage through an insulator 15.

The carriage 13 is mounted for reciprocation along two guides 16 having their ends secured in brackets 17 fastened to a base 18 rigidly attached to the chamber 1.

Figure 3:
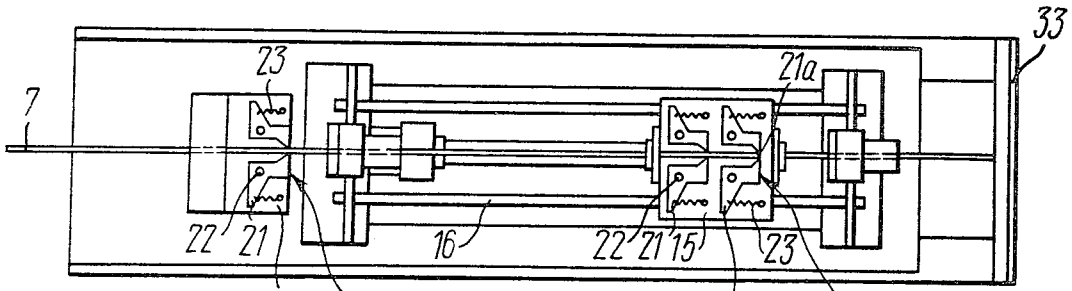
FIG. 3 shows the same as in FIG. 2, plan view,/the chamber and the electrode holder not shown, for clarity sake/.

The guides 16 extend parallel with the plunger rod 12 of the hydraulic cylinder 11, to both sides of this plunger rod 11, as it can be seen in FIG. 3.

The base 18 supports thereon another insulator 19 supporting, in its turn, a stationary clamp 20.

In the presently described embodiment each clamp 14 and 20 includes a pair of bell cranks 21 arranged symmetrically with respect to the electrode 7 (or 8) extending therebetween.

Each bell crank 21 is pivotably mounted on a pin 22 affixed on the insulator 15, for pivoting motion about this pin 22 under the action of a spring 23 having one extremity thereof secured to one arm of each respective bell crank 21. The other end of each respective spring 23 is connected to the respective insulator 15 or 19.

Figure 2:
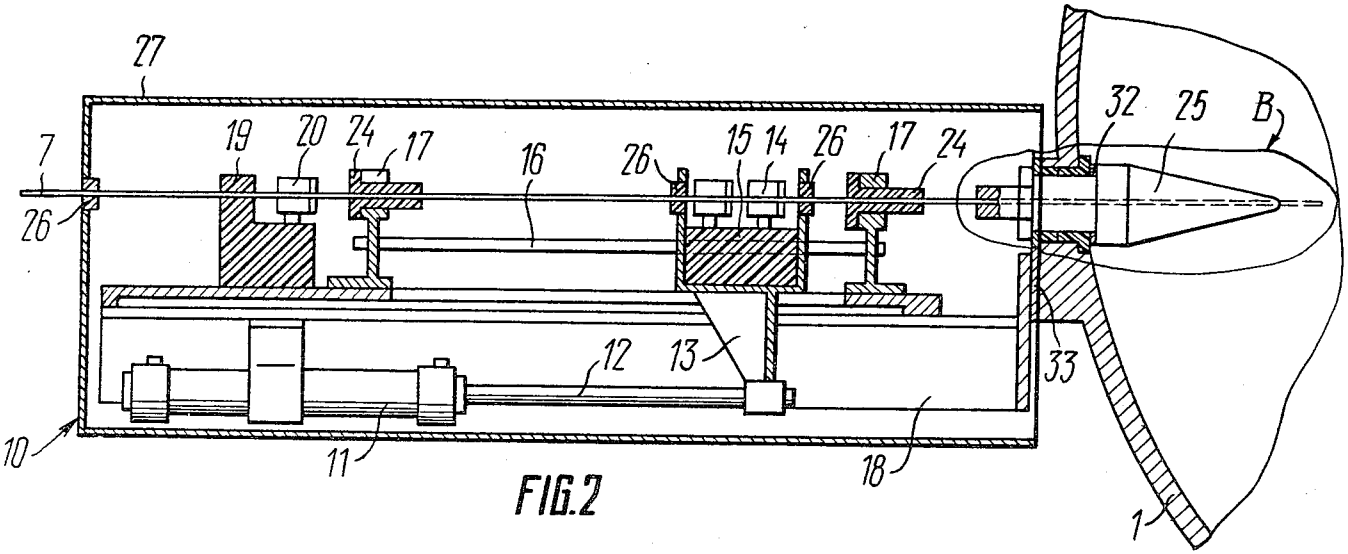
FIG. 2 shows an enlarged partial longitudinal sectional view of the area A in FIG. 1.

The arm of the bell crank 21, opposite to the one associated with the respective spring 23, has a pointed end portion 21 *a*, adapted to grip firmly the electrode 7 (or 8), as shown in FIGS. 2 and 3.

Each bracket 17 has mounted thereon an insulator bush 24 which also serves as a guide for the electrode 7 (or 8) extending therethrough toward an electrode holder 25 extending parallel with the plunger rod 12. Wherever the electrode 7 (or 8) passes through the components of the attachment 10, insulators 26 are provided.

The attachment 10 is enclosed within a casing 27 secured detachably to the base 18 with any suitable fastening means.

Figure 4:
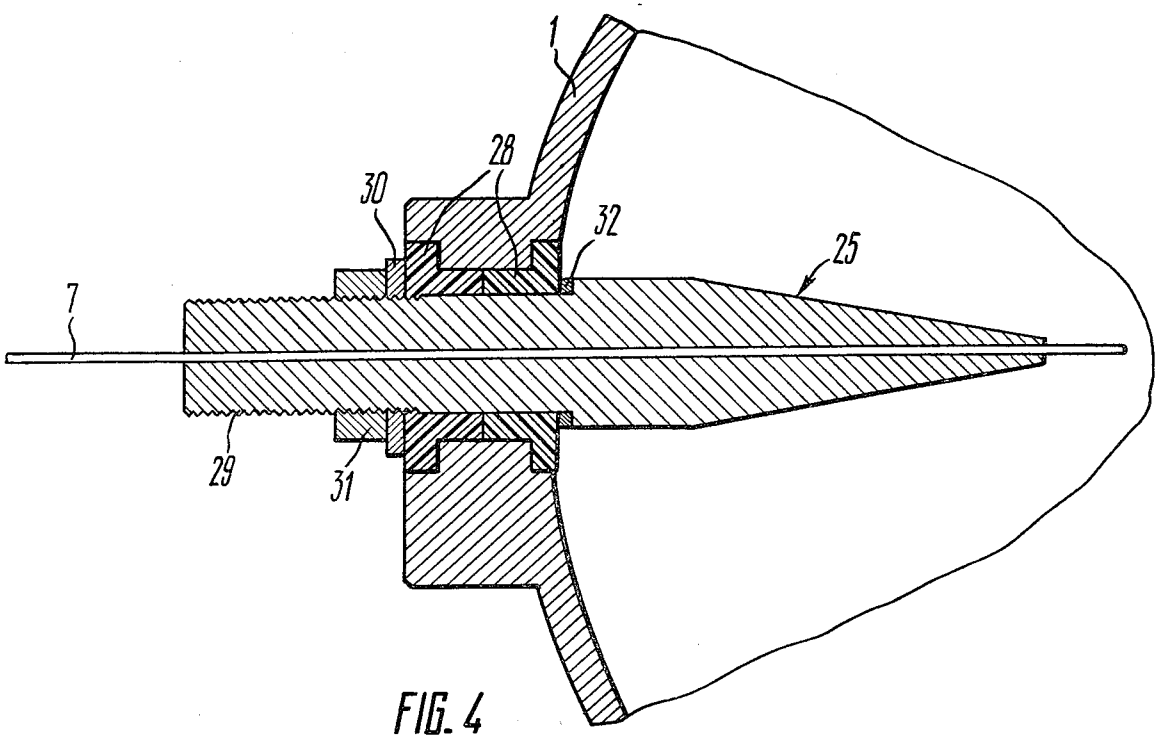
FIG. 4 is a schematic representation on an enlarged scale of the area B in FIG. 2.

Each electrode holder 25 (FIG. 4) has an axial through-going bore for the passage of the electrode 7 (or 8). The holder 25 also receives thereabout insulation bushes 28 adapted to insulate electrically the holder 25 from the chamber 1. The end of the holder 25 protruding beyond the chamber 1 is externally threaded (29), this threaded portion 29 receiving thereabout a washer 30 and threadedly receiving a nut 31 which fastens the electrode holder 25 to the chamber 1.

Electric contact of the electrodes 7, 8 with the explosion-initiating wire 9 at working of materials 5 having slightly different dimensions and shapes is ensured by positioning the devices 10 and the holders 25 with a required accuracy relative to the chamber 1, with aid of adjustment gaskets 32 and 33.

The herein disclosed embodiment of a plant for explosion working of materials also incorporates a ventilation system 34 (FIG. 1) for clearing the chamber 1 from the detonation products of the charge 6 of the explosive. The ventilation system can be of any known structure suitable for the purpose.

In cases where toxic materials are treated by the herein disclosed plant, the latter preferably incorporate a nozzle 35 mounted in the chamber 1 and connected to a source (not shown) of a composition, e.g. in a liquid form, capable of neutralizing the toxicity of this material 5.

In the presently described embodiment the nozzle 35 has a housing 36 (FIG. 5) in-built within the chamber 1. The housing 36 of the nozzle 35 receives therein a sleeve 37 being in threaded engagement 38 with the housing 36. Between the housing 36 and the sleeve 37 there is left an annular passage 39, and the sleeve 37 has a tube 40 extending coaxially with the nozzle 35, the axis of the latter coinciding with the axis O—O of the chamber 1 (FIG. 1).

Intermediate the tube 40 and the sleeve 37 there is likewise left an annular passage 41 into which the neutralizing composition can be fed from the source (not shown). The passage 41 communicates with the passage 39 via openings 42 made through the sleeve 37 in a direction substantially radial with respect to the axis O—O. The flange 37*a* of the sleeve 37 defines with the housing 36 of the spray nozzle 35 a bottleneck portion 39*a* of the passage 39, so as to build up the pressure at the outlet of the passage 39. In this way there is ensured a continous and uniformal flow of the liquid neutralizing composition down the entire internal wall surface of the chamber 1 with the purpose to prevent settling of the toxic products of explosion working of the material 5 on this surface, the products being carried away with the flow of the liquid thus being removed from the chamber 1.

The tube 40 communicates with the internal space of a tip 43 welded to the sleeve 37 and further communicates with the internal space of the chamber 1 via radial openings 44 through the tip 43. The tube 40 and the tip 43 with the openings 44 are intended for supplying the neutralizing liquid from the source (not shown) into the chamber 1 in a plurality of jets for the products of explosion working of the material 5, suspended in the chamber, to settle down.

The operation of the plant for explosion working of materials will be described hereinbelow in connection with the operation of explosion-welding a sealing ring to a piston.

In the initial position of an operating cycle, shown in FIG. 1, the chamber accommodates therein a work table 4 with the material 5 to be worked, which in the presently described example of operation is a piston designated with the same numeral 5.

The sealing ring received about the piston 5 is coated with the charge 6 of an explosive, into which the explosion initating means in the form of the wire 9 is embedded.

The operator actuates the attachment 10 for advancing the electrodes 7, 8 into electric contact with the wire 9.

With each attachment 10 actuated, the plunger rod 12 of the respective hydraulic cylinder 11 is projected forward, the carriage 13 moving together with the plunger rod 12 along the guides 16, the carriage 13 carrying thereon, as it has been already described, the clamps 14 mounted on the carriage 13 with aid of the insulator 15. The carriage 13 moves along the guides 16 with the ends thereof being secured to the respective brackets 17 fixedly attached to the base 18 secured to the chamber 1.

The clamps 20 do not interact at this stage with the electrodes 7, 8.

The bell cranks 21 of the clamps 14 pivot about their respective pins 22 under the action of the springs 23 and drivingly engage with their pointed ends 21*a* the electrodes 7, 8, which latter are thus pushed by the motion of the plunger rods 12 through the insulators 19, 24 and 26 and through the holders 25 toward the centre of the chamber 1, until they contact the explosion-initiating wire 9, whereafter an electric pulse is fed through the electrodes 7, 8 to the wire 9, and the explosive charge explodes.

The detonation products of the explosion press the sealing ring to the piston body with a great force and at a very high speed, the material of the sealing ring and that of the piston body being thus welded together by the impact therebetween.

The force of the explosion blows off the portions of the electrodes 7, 8, projecting from the respective holders 25, the broken away pieces falling into the bottom part of the chamber 1.

The ventilation system 34 is operated to clear the chamber 1 from the detonation products of the explosive charge 6.

Following the explosion and a corresponding command sent by the operator of the plant, the plunger rods 12 are retracted back into the respective hydraulic cylinders 11, the clamps 14 now releasing the electrodes 7 and 8, owing to the pivoting of the bell cranks 21 of these clamps, and the carriages 13 are returned to their initial positions. During this motion the electrodes 7 and 8 are stationary, because the bell cranks 21 of the stationary clamps 20 engage and retain the electrodes 7, 8 with their pointed ends 21*a*, under the action of the respective springs 23 which urge the bell cranks 21 to pivot in the respective direction about their pivot pins 22.

Thus, the carriage 13 and the clamps 14 slide along the electrodes 7 and 8, and in this manner the electrode advancing attachment resumes its initial position.

Figure 5:
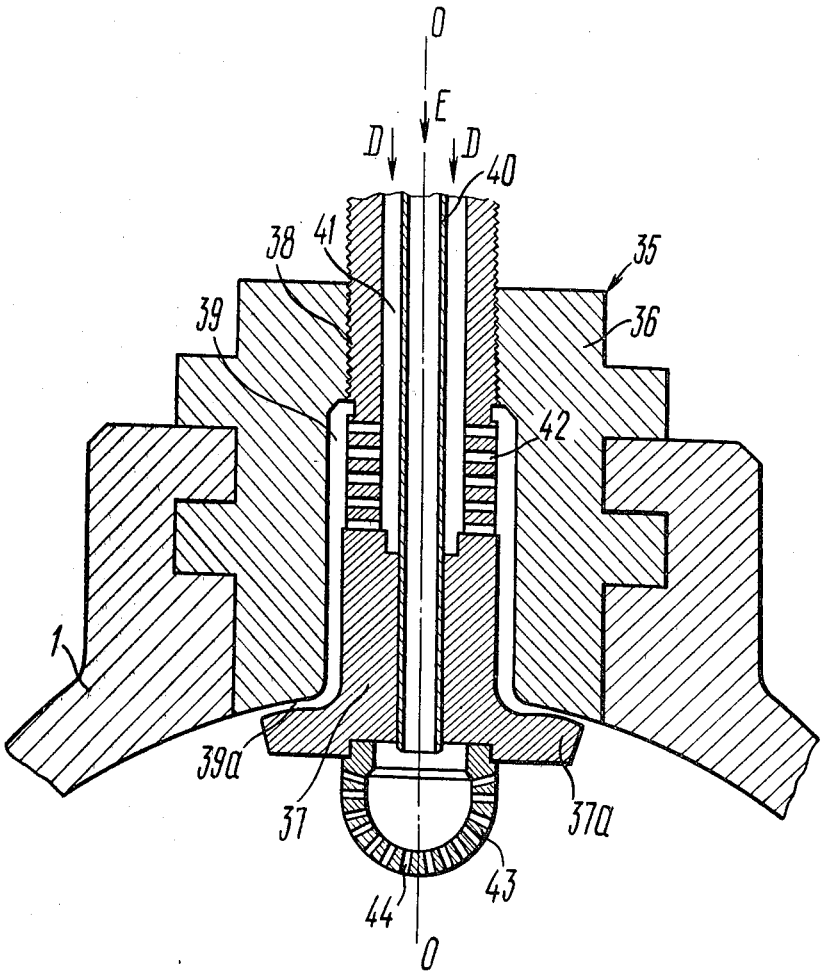
FIG. 5 is a longitudinal sectional enlarged view of the area C in FIG. 1.

In applications when toxic materials are worked, during the explosion the neutralizing composition is fed into the chamber in the directions indicated with arrows D in FIG. 5. The liquid composition flows via the annular passage 41 and enters the annular passage 39 via the openings 42 provided in the sleeve 37, the annular passage 39 being defined intermediate the housing 36 of the nozzle 35 and the sleeve 37. Therefrom the liquid composition through the bottleneck 39*a* of the passage 39 flows onto the internal wall of the chamber 1 and flows down therealong, preventing settling of the toxic products and carrying them away in its flow from the chamber 1.

Following the explosion, the liquid composition is fed into the chamber 1 not through the bottleneck 39*a* of the passage 39, but through the tube 40 in the direction of the arrow E into the tip 43, wherefrom it is sprayed in a plurality of jets issuing from the radial openings 44 into the chamber 1. These jets of the liquid composition ensure that the toxic products of explosion working of the material 5, suspended in the chamber 1, settle down.

Upon the explosion working cycle, as described hereinabove, having been completed, the material 5 is automatically removed from the chamber 1, whereafter this working cycle can be repeated.

A test pilot model of the herein disclosed plant for explosion working of materials has been subjected to many-sided testing of which the outcome has proved the high efficiency of the plant.

Moreover, the plant for explosion working of materials has proved to be safe and simple in operation.

The materials treated and worked in this plant have proved to be of a high quality.

We claim:

1. A plant for explosion working of materials, comprising: a stationary support; a chamber mounted on said stationary support; a work table accommodated within said chamber and adapted to support thereon a material to be worked upon, the material having a charge of an explosive applied thereon, the explosive having means for initiating an explosion embedded therein; at least one electrode for furnishing an electric pulse to said explosion initiating means, said at least one electrode being mounted in said chamber for an advancing motion towards said explosion initiating means into electric contact with said explosion initiating means; movement means for effecting said advancing motion of said at least one electrode toward said explosion initiating means by a distance equalling the length of the portion of said electrode separated therefrom by an explosion; and ventilation means mounted in said chamber and adapted to remove therefrom the products of detonation of said explosive charge.

2. A plant as claimed in claim 1 wherein, for applications involving working of toxic materials, said chamber has nozzle means mounted therein for supplying into said chamber a liquid composition for neutralizing the toxicity of the materials.

3. A plant as claimed in claim 2 wherein said nozzle means comprises: first means for applying the liquid composition to internal walls of said chamber; and second means for spraying the liquid composition into the interior of said chamber.

4. A plant as claimed in claim 1 having a plurality of electrodes mounted in said chamber, said movement means further comprising means for independently advancing each of said plurality of electrodes into electric contact with said explosion initiating means.

5. A plant for explosion working of materials, comprising: a stationary support; a chamber defining an explosion space mounted on said stationary support; a work table accommodated within said chamber and adapted to support thereon a material to be worked upon, the material having a charge of an explosive applied thereon, the explosive having means for initiating an explosion embedded therein; at least one electrode for furnishing an electric pulse to said explosion initiating means; holding means connected to said chamber for holding said at least one electrode for an advancing motion into said explosion space towards said explosion initiating means into electric contact with said explosion initiating means and for preventing explosion damage to the portion of said at least one electrode outside of said explosion space; drive means for effecting said advancing motion of said at least one electrode through said holding means toward said explosion initiating means a distance equalling the length of the portion of said electrode separated therefrom by an explosion; and ventilation means mounted in said chamber and adapted to remove therefrom the products of detonation of said explosive charge.

* * * * *